United States Patent [19]

Sparer et al.

[11] Patent Number: 4,998,714

[45] Date of Patent: Mar. 12, 1991

[54] SHEET-FEEDING APPARATUS WITH ONE-WAY CLUTCH TO AVOID PREMATURE SHEET-FEED DURING SHEET RELOADING

[75] Inventors: Steven J. Sparer, Rochester; William I. Morris, Oakfield, both of N.Y.

[73] Assignee: Eastman Kodak Company, Rochester, N.Y.

[21] Appl. No.: 408,824

[22] Filed: Sep. 18, 1989

[51] Int. Cl.[5] ..... B65H 3/06

[52] U.S. Cl. ..... 271/117; 271/164

[58] Field of Search ..... 271/21, 109, 114, 116, 271/117, 145, 157, 162, 164

[56] References Cited

U.S. PATENT DOCUMENTS 4,231,566 11/1980 Suzuki ..... 271/117
4,577,850 3/1986 Takeyama et al. ..... 271/164 X
4,799,662 1/1989 Sagara et al. ..... 271/164 X

FOREIGN PATENT DOCUMENTS 0048335 5/1981 Japan ..... 271/117
0166236 10/1982 Japan ..... 271/117
0238626 10/1986 Japan ..... 271/117

*Primary Examiner*—H. Grant Skaggs
*Assistant Examiner*—Born Milef
*Attorney, Agent, or Firm*—Warren W. Kurz

[57] ABSTRACT

A sheet-feeding apparatus comprises sheet-feeding rollers for advancing sheets, one at a time, from a stack of sheet material. The sheet-feeding rollers are supported by a drive shaft which is mounted for movement toward and away from the sheet stack so that the feed rollers may be selectively displaced from the stack, for example, to effect sheet replenishment. A cam surface associated with a slidable stack support cooperates with a cam-follower associated with the roller shaft to effect displacement of the feed rollers from the stack during sliding movement of the stack support. A pair of one-way clutches and a rack and pinion arrangement cooperate to allow the sheet-feed rollers to rotate freely during initial contact with the top sheet in the stack, thereby avoiding premature feeding of such sheet during a stack reloading process.

6 Claims, 10 Drawing Sheets

SHEET-FEEDING APPARATUS WITH ONE-WAY CLUTCH TO AVOID PREMATURE SHEET-FEED DURING SHEET RELOADING

BACKGROUND OF THE INVENTION

The present invention relates to improvements in apparatus for feeding sheet material in sheet utilization devices, such as printers and document copiers. The invention addresses the technical problem of loading and unloading sheet cassettes from such devices without having the sheet-feeding mechanism of such devices disturb the alignment and registration of sheets contained by the cassette.

In printers and document copiers, it is common to sequentially feed cut sheets of material (e.g., film or paper) from a sheet supply station to an image recording or transfer station where image information is produced on the individual sheets. In many such devices, the cut sheets are stacked in a sheet supply tray or cassette which can be readily removed from the sheet-feeding station for purposes of reloading the cassette with additional sheets or for substituting a different cassette containing sheets of a different size. Typically, the sheet-feeding stations of the printer or copier includes one or more sheet-picking rollers (e.g., scuff rollers) which, when positioned to engage the topmost sheet in the stack and suitably driven, serve to advance such sheet along a desired sheet path.

Prior to unloading a sheet cassette from a sheet supply station, it is common practice to displace the sheet-feeding roller from the topmost sheet in the stack. Otherwise, frictional engagement between the feed roller and the topmost sheet will act to upset the alignment of the sheets in the stack during removal movement of the cassette from the sheet-feeding station. If unnoticed and uncorrected, such misalignment of the sheets can ultimately produce paper jams, either in the sheet supply station, or further downstream along the sheet-feeding path.

Heretofore, it has been common to use some sort of electromechanical mechanism to achieve the desired spacial relationship between the sheet-feeding roller and the sheet stack prior to unloading the sheet cassette from the printer or copier. Such mechanism usually serves either to lower the sheet stack with respect to the feed roller, or to raise the feed roller with respect to the sheet stack. Electromechanical mechanisms which incorporate solenoids and motors are often used to achieve such lowering or raising functions. Such mechanisms, of course, not only add significant cost to the equipment, but also have an adverse impact on its reliability.

SUMMARY OF THE INVENTION

In view of the foregoing discussion, an object of this invention is to provide a simple, reliable and low-cost mechanical scheme for separating a sheet-feeding mechanism from a sheet stack in order to avoid the above-noted sheet-misalignment problem.

According to the invention, a movable sheet supply station is provided with a cam surface which moves with the sheet supply during movement of the supply between an operative, sheet-feeding position and an inoperative, sheet-loading position. A sheet-feeding mechanism is mounted for movement toward and away from the topmost sheet in a sheet supply when the latter is located in its operative, sheet-feeding position. The sheet-feeding mechanism includes a cam-follower which cooperates with the cam surface of the supply station to cause the sheet-feeding mechanism to be displaced from the topmost sheet in the supply during movement of the sheet supply between its operative and inoperative positions. Preferably, the sheet-feeding mechanism comprises a scuff roller mounted on a rotatably driven drive shaft. During movement of the sheet supply towards its operative sheet-feeding position, a pair of one-way clutches, a rack-and-pinion system and a drive and driven member arrangement cooperate to assure that the scuff roller does not move the topmost sheet, thereby preventing the scuff roller from disturbing the stack alignment or causing a premature sheet-feed.

The invention and its various advantages will become more apparent to those skilled in the art from the ensuing detailed description of a preferred embodiment, reference being made to the accompanying drawings.

DETAILED DESCRIPTION OF A PREFERRED EMBODIMENT

Figure 1:
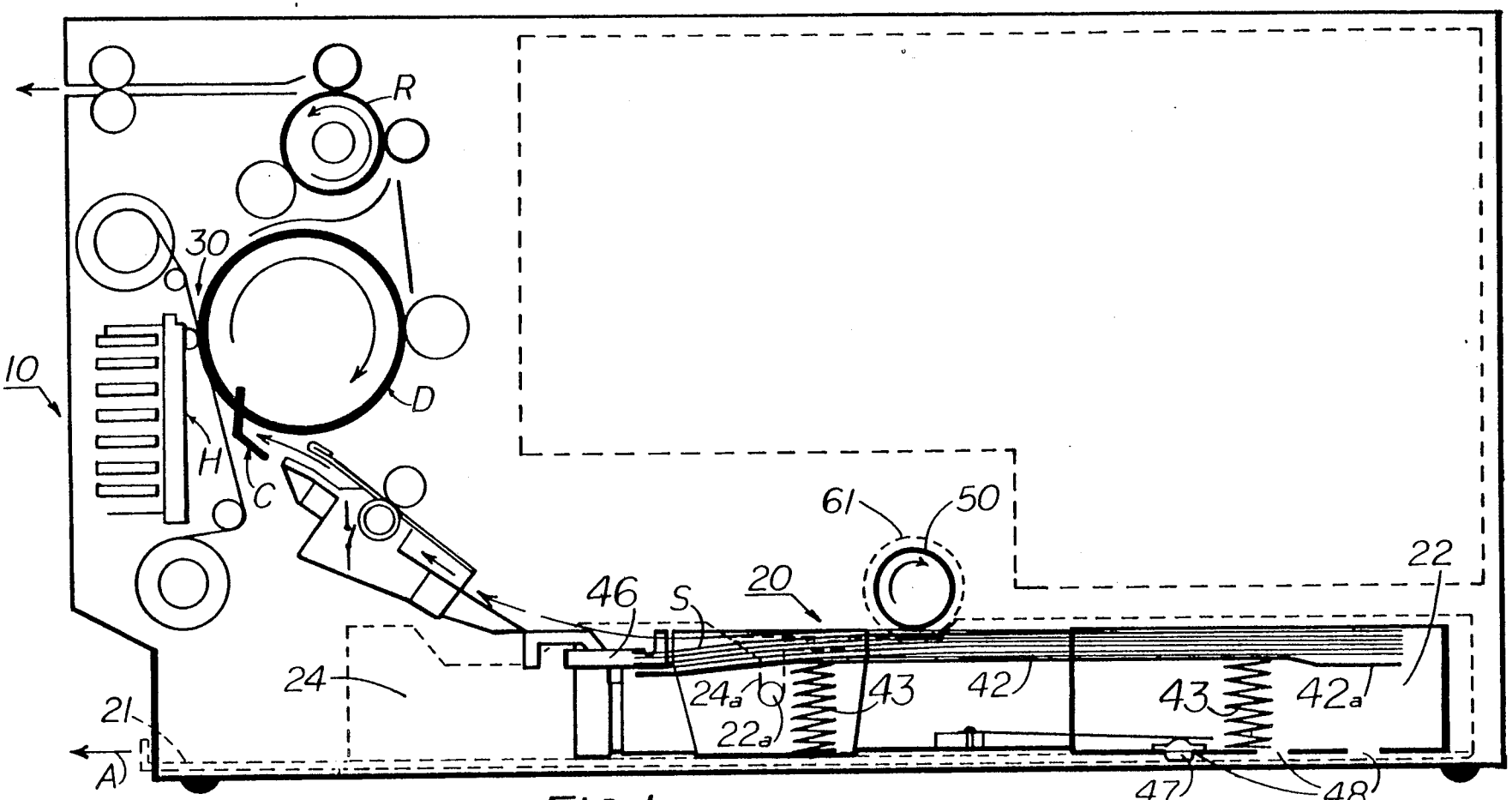
FIG. 1 is a schematic illustration of a thermal printer embodying the sheet-feeding apparatus of the present invention.

FIG. 1 depicts a sheet utilization device 10, in this case a thermal printer, which is adapted to print color images on each of a plurality of dye absorbing, image-receiving sheets S. The printer includes a sheet supply station 20 from which the image-receiving sheets are advanced, seriatim, from a sheet cassette 22 towards a sheet-processing station 30, in this case the print head H of the thermal printer. Since thermal printers are well known in the art and simply represent the type of device in which the present invention finds utility, a detailed explanation of the printer operation will be dispensed with. Briefly, however, the leading edge of a sheet advancing from the supply station 20 is clamped by clamp C to a rotating drum D which rotates, one or more times, past print head H to produce one or more dye-transferred thermal images in registration on the image-receiving sheet. Thereafter, the drum rotation is reversed, and the trailing edge of the receiver sheet is guided toward a heated roller R which, as the sheet passes in contact therewith, permanentizes the dye images on the sheet. For a better explanation of the operation of a thermal printer, references made to the commonly assigned U.S. Pat. No. 4,710,783, issued in the names of Caine and Brownstein.

Figure 2:
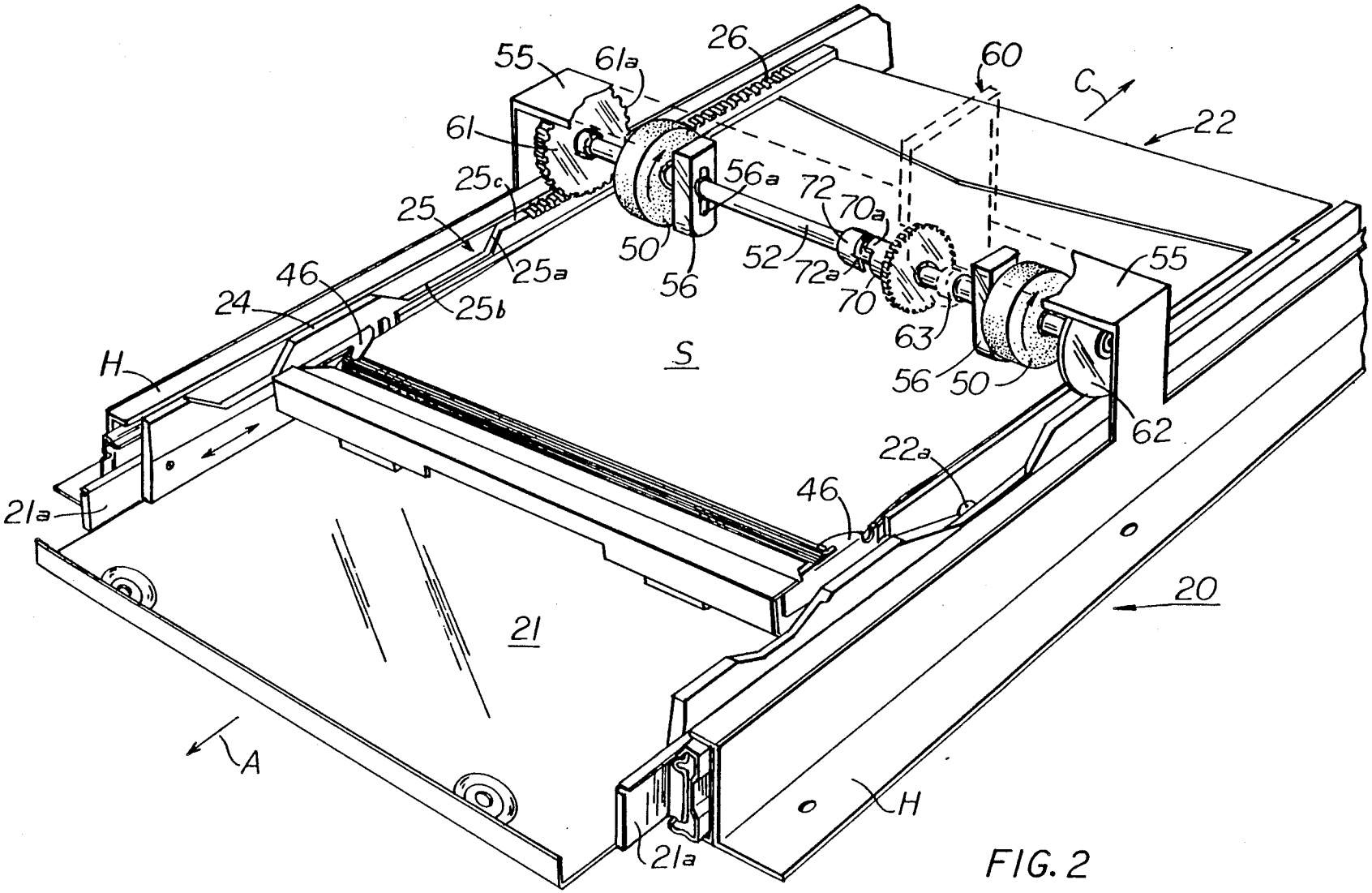
FIG. 2 is a side perspective view of the sheet-feeding apparatus of the invention.

Referring to FIG. 2, sheet supply station 20 comprises a slidably mounted platform 21 which supports the sheet cassette 22. As better shown in FIGS. 3 and 4, the cassette-supporting platform 21 has a pair of vertically-extending side walls 21*a*, each being rigidly connected with the innermost of a plurality of telescoping rails 23 which enable the platform to move in the direction of the arrow A relative to the fixed printer housing H. Relative movement between platform 21 and printer housing H is best shown in the comparative views of FIGS. 3 and 4. Each of the platform's side walls 21*a* has rigidly attached thereto a trunion plate 24, each having a cassette-locating notch 24*a* form therein. The respective notches 24*a* are adapted to receive and support a pair of pins 22*a* extending outwardly from the sides of the sheet cassette (see, e.g., FIG. 9A). This notch and pin arrangement serves to fix the forward/backward location of the cassette (i.e. in the direction of arrow A) relative to platform 21. For reasons described below, each of the trunion plates 24 is provided with a cam surface 25 comprising a ramp portion 25*a* disposed between two relatively flat, but vertically spaced, portions 25*b* and 25*c*.

Sheet cassette 22 is best shown in FIGS. 9A, 9B, 10A, and 10B. Cassette 22 basically comprises a topless tray 40 in which a spring-biased pressure plate 42 is disposed. Plate 42 is biased in an upward direction by a plurality of compression springs 43 located between the bottom surface of the pressure plate and the bottom wall 40*a* of the tray. Upward movement of a plate 42 is limited by a horizontally-extending plate member 44 which is integral with and extends between a pair of rails 45 slidably mounted on the respective side walls 40*b* of the tray 40. As indicated above, cassette locator pins 22*a* extend outwardly from the side walls 40*b* of tray 40. Upward movement of plate 42 is also limited by the respective top edges of a pair of slots (not shown) formed in the tray's forward wall 40*c*. A pair of tabs 42*b* extending from the forwardmost edge of plate 42 protrudes through these slots. A stack of receiver sheets supported by the cassette is trapped between the upwardly-biased pressure plate 42 and member 44, the latter spanning across the rear portion of the topmost sheet in the stack. A pair of corner snubbers 46 serve to engage and hold down the respective forward corners of the topmost sheet in the stack. Thus, it will be appreciated that, owing to the upwards bias of pressure plate 42, the topmost sheet in the stack will always be located in the same horizontal plane.

Figure 9A:
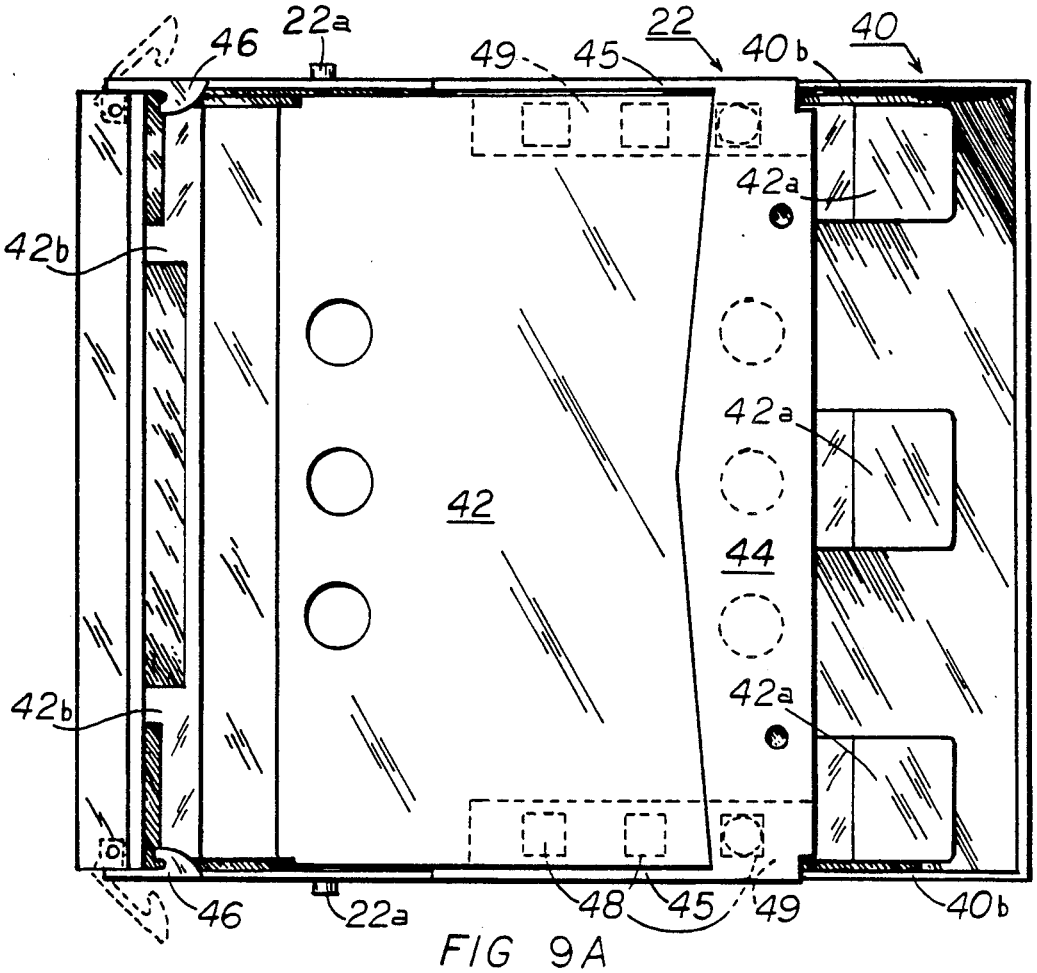
FIGS. 9A and 10A are top plan views of a paper cassette adapted to receive sheets of different sizes.
Figure 9B:
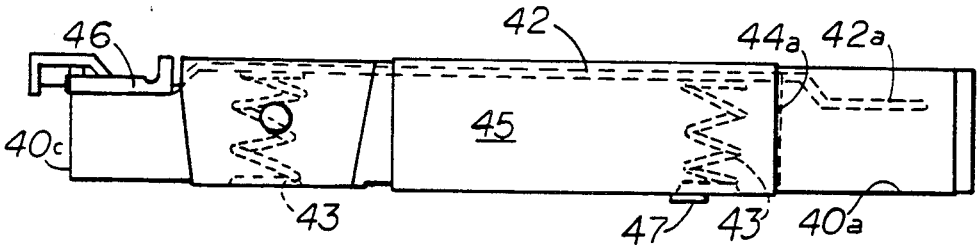
FIGS. 9B and 10B are side elevations of the cassettes shown in FIGS. 9A and 10A, respectively.
Figure 10A:
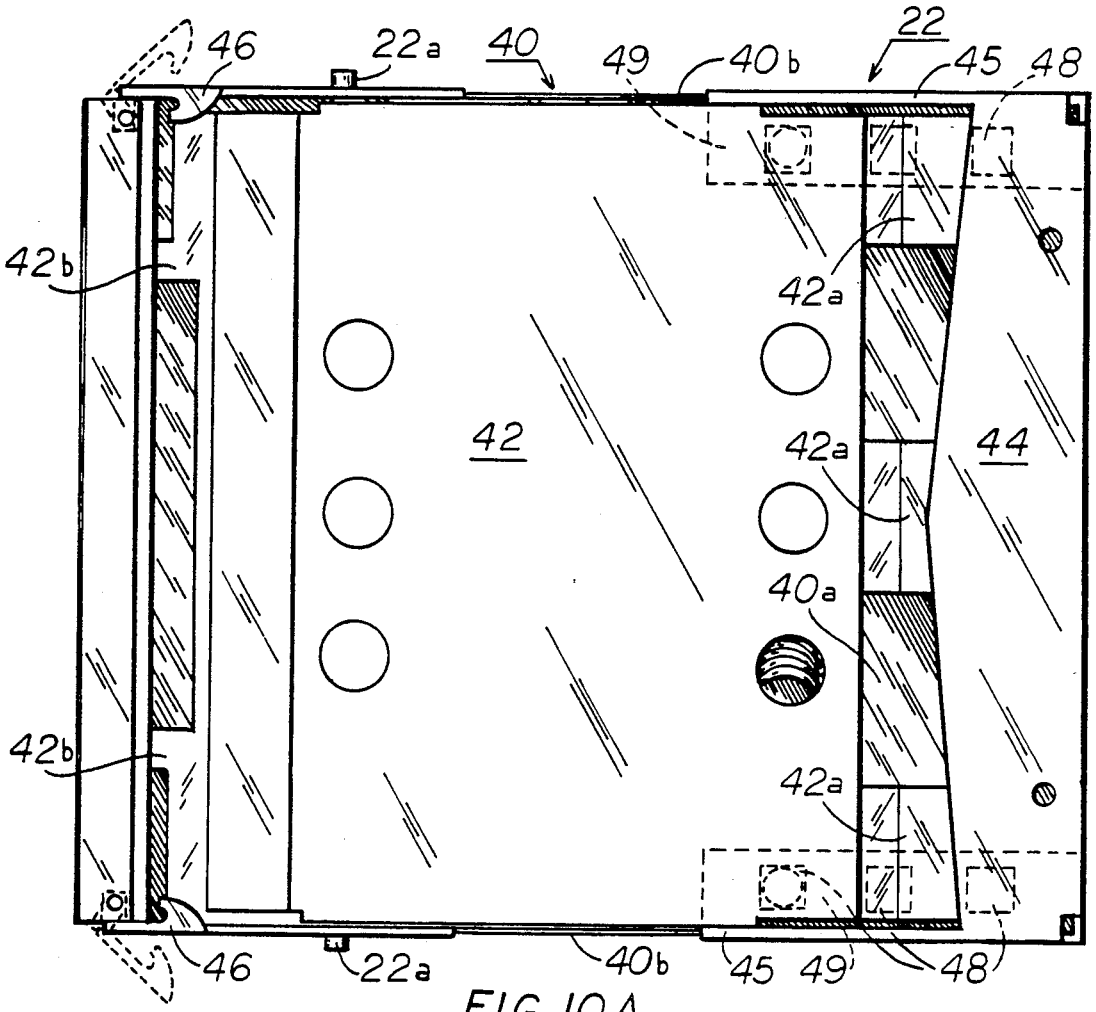
Figure 10B:
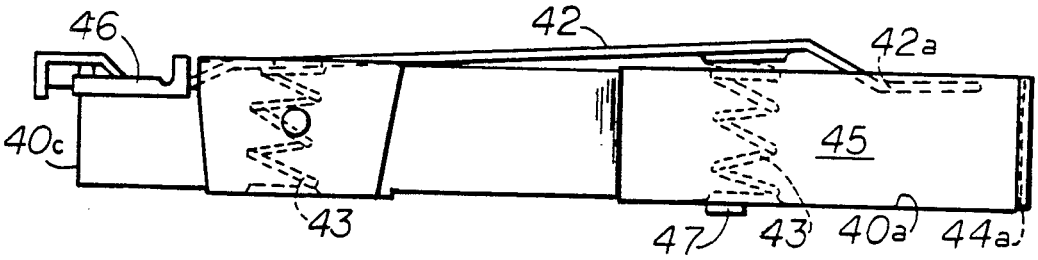

Sheet cassette 22 is adjustable to receive sheets of differing lengths. Preferably, the slidably mounted plate member 44 is provided with a pair of downwardly depending tabs 44*a* located in the space defined by three tabs 42*a* of the pressure plate. Tabs 44*a* are intended to loosely contact the respective rear edges of the sheets contained by the cassette and thereby maintain the sheets in alignment. To accommodate sheets of different lengths, a detent arrangement is provided to set the position of member 44 at different locations relative to the cassette tray. Such detent arrangement comprises a pair of spring loaded pins 47 extending downwardly from the bottom wall of the tray, and a series of slots 48 formed in a horizontally-extending flange 49 on each rail 45. In FIGS. 9A and 9B, member 44 is shown in a position to accomodate sheets of relatively short length, whereas in FIGS. 10A and 10B, member 44 has been moved to a second position to accommodate sheets of greater length.

Referring to FIGS. 2–8, the sheet-feeding apparatus of the invention preferably comprises a pair of sheet-feeding scuff rollers 50 which are mounted for rotation with a rotatably driven shaft 52. Each of the rollers 50 may comprise, for example, a soft or compliant rubber roller which, when driven in the direction of the arrows and positioned to frictionally engage the top most sheet in the cassette, will cause such sheet to buckle and snap free of corner snubbers 46. Once free of these corner snubbers, the beam strength of the sheet will then project the leading edge thereof along the desired sheet path. Drive shaft 52 is supported for vertical movement above the sheet stack by a yoke 55 which is connected to the printer housing and spans across the cassette-supporting platform 21. Yoke 55 supports a pair of downwardly-depending, hollow housings 56, each having a slot 56*a* formed therein for allowing shaft 52 to rise and fall relative to the plane of platform 21. As best shown in the cross sectional views of FIGS. 7 and 8, each housing 56 contains a coil spring 57 which serves to bias the shaft in a downward direction, towards the bottom of slot 56*a*. When located in this downward-biased position, the scuff rollers will, as explained below, be in sheet-feeding engagement with the topmost sheet in a stack supported by platform 21. When shaft 52 is located in its raised or elevated position (against the biasing force of spring 57) scuff rollers 50 are spaced above the topmost sheet in the cassette.

Drive shaft 52 is rotatably driven by a motor M and its associated gear train 60, both being mounted on a support plate P. The latter supports a bearing 63 in which shaft 52 is rotatably mounted, and the entire motor and gear train assembly is slidably coupled to yoke 55 so as to enable it to move vertically with shaft 52, whenever the latter is caused to move vertically in slots 56*a* of housings 56. When energized, the motor and gear train assembly rotates a drive gear 70 which is rotatably supported on shaft 52. Drive gear 70 is provided with a tang 70*a* which engages a similar tang 72*a* extending from a driven member 72, the latter being rotatably supported by shaft 52 via a one-way clutch. When driven in the direction of arrow B, the driven member drivingly engages the shaft and causes it to rotate. When member 72 is driven in the opposite direction, it rotates freely on shaft 52, as explained below.

In order to selectively elevate scuff rollers 50 relative to the sheet cassette, shaft 52 is provided with a pair of rollers 61 and 62 at its respective distal ends. Rollers 61 and 62 are positioned to ride along the respective cam surfaces 25 of trunion plates 24 and thereby function as cam-followers. Preferably, the circumferences of roller 61 is provided with teeth 61*a*, thereby enabling roller 61 to function as a pinion. The teeth of this pinion are adapted to mesh with a rack of teeth 26 formed in the upper horizontal portion 25*c* of the cam surface 25 over which it rides. For reasons explained below, the pinion (roller 61) is mounted on shaft 52 by means of a second one-way clutch. The manner in which the above-described apparatus operates to solve the aforementioned technical problem will now be described.

Figure 3:
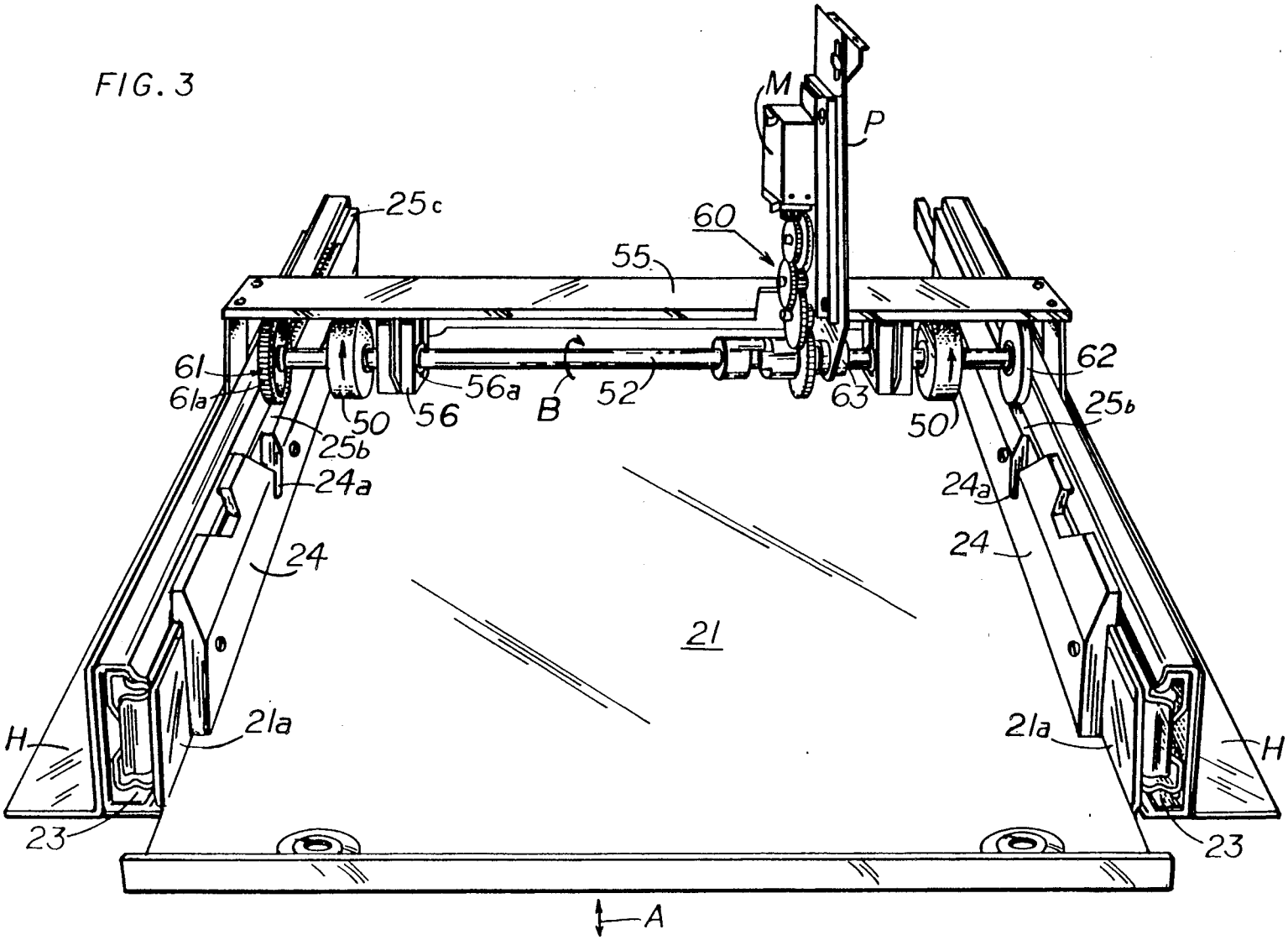
FIGS. 3 and 4 are front perspective views of the FIG. 2 apparatus illustrating the sheet-feeding mechanism in two different vertical positions.
Figure 4:
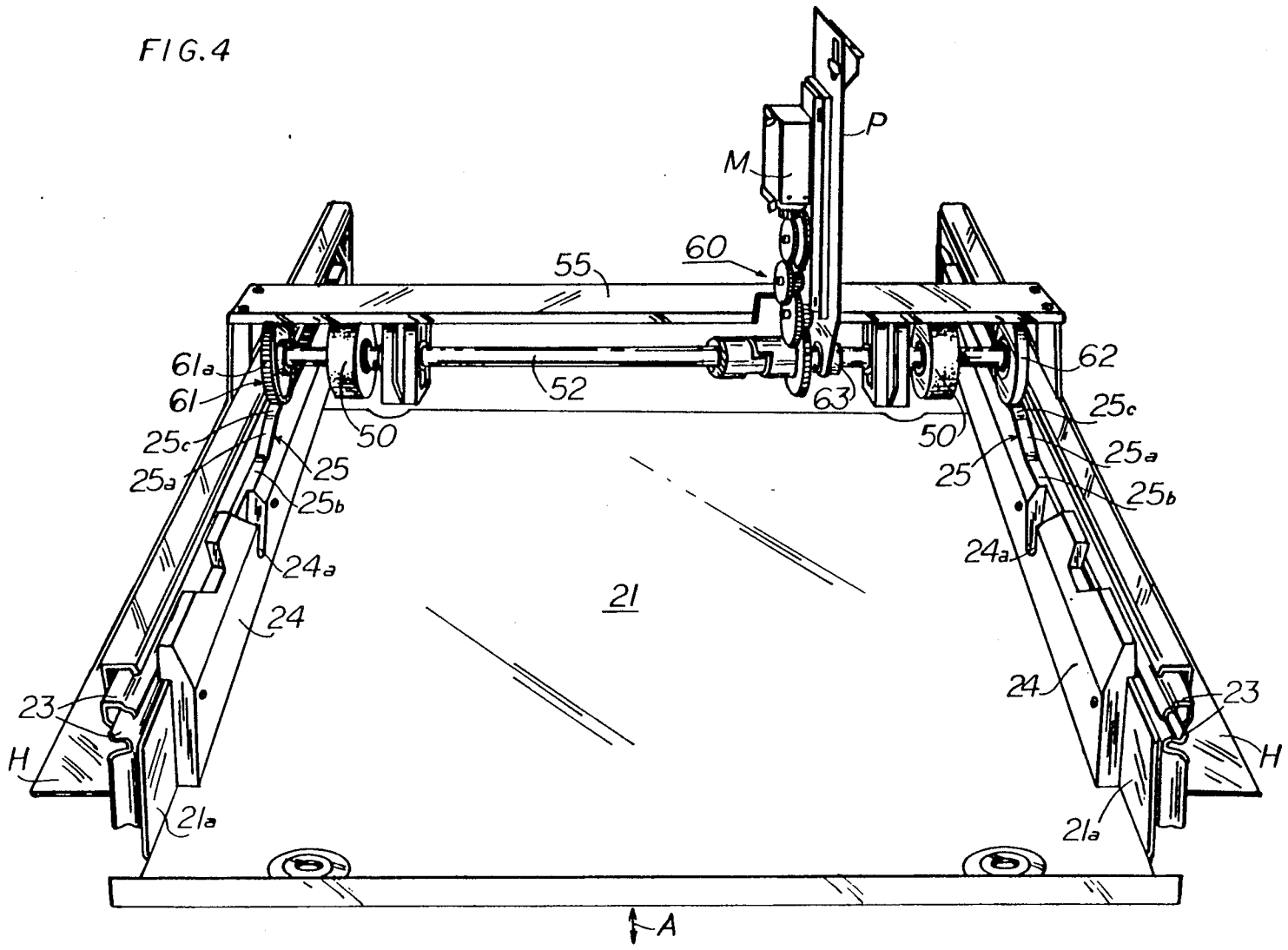
Figure 5:
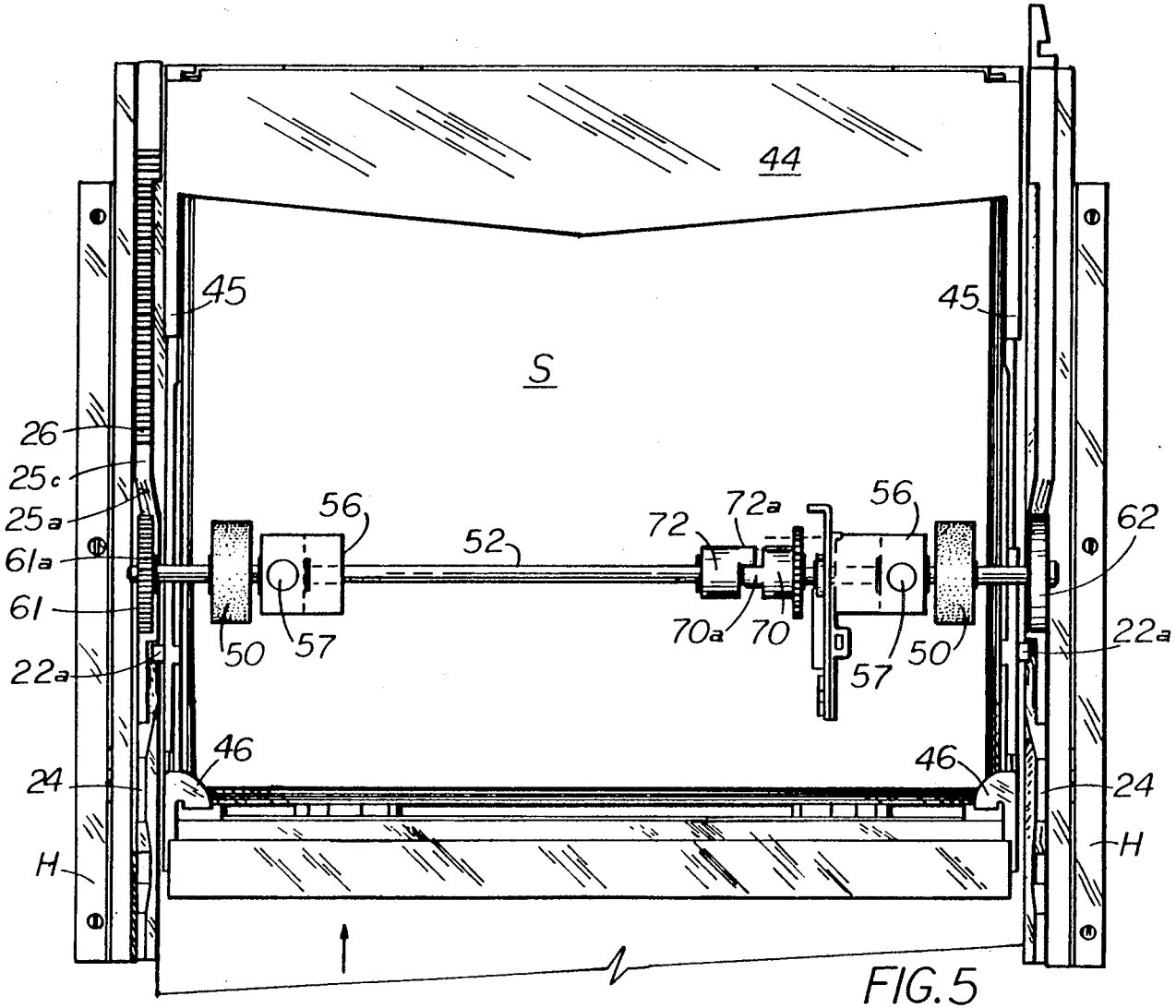
FIGS. 5 and 6 are top perspective views of the FIG. 2 apparatus illustrating the sheet supply in two different positions relative to the sheet-feeding mechanism.
Figure 6:
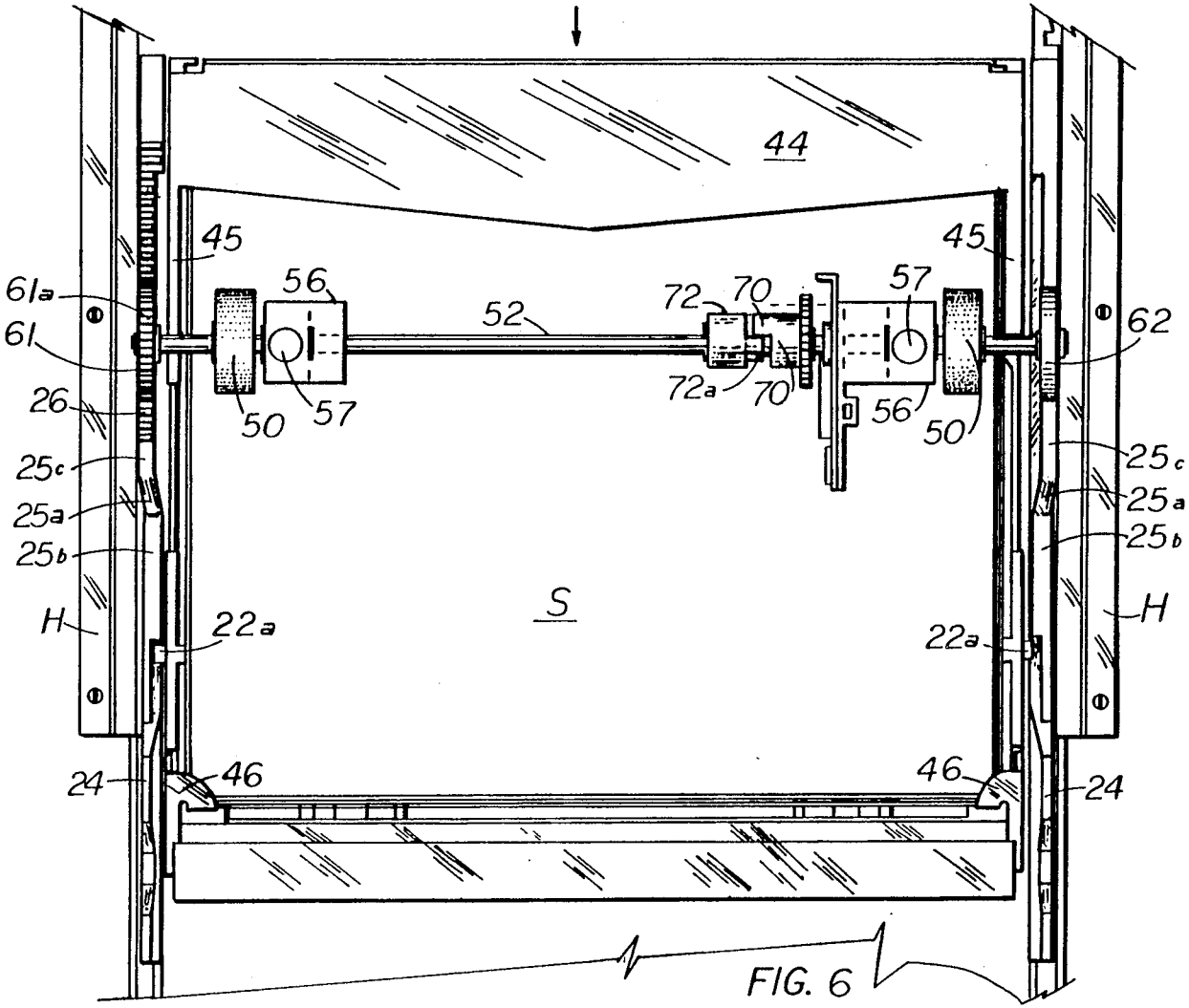
Figure 7:
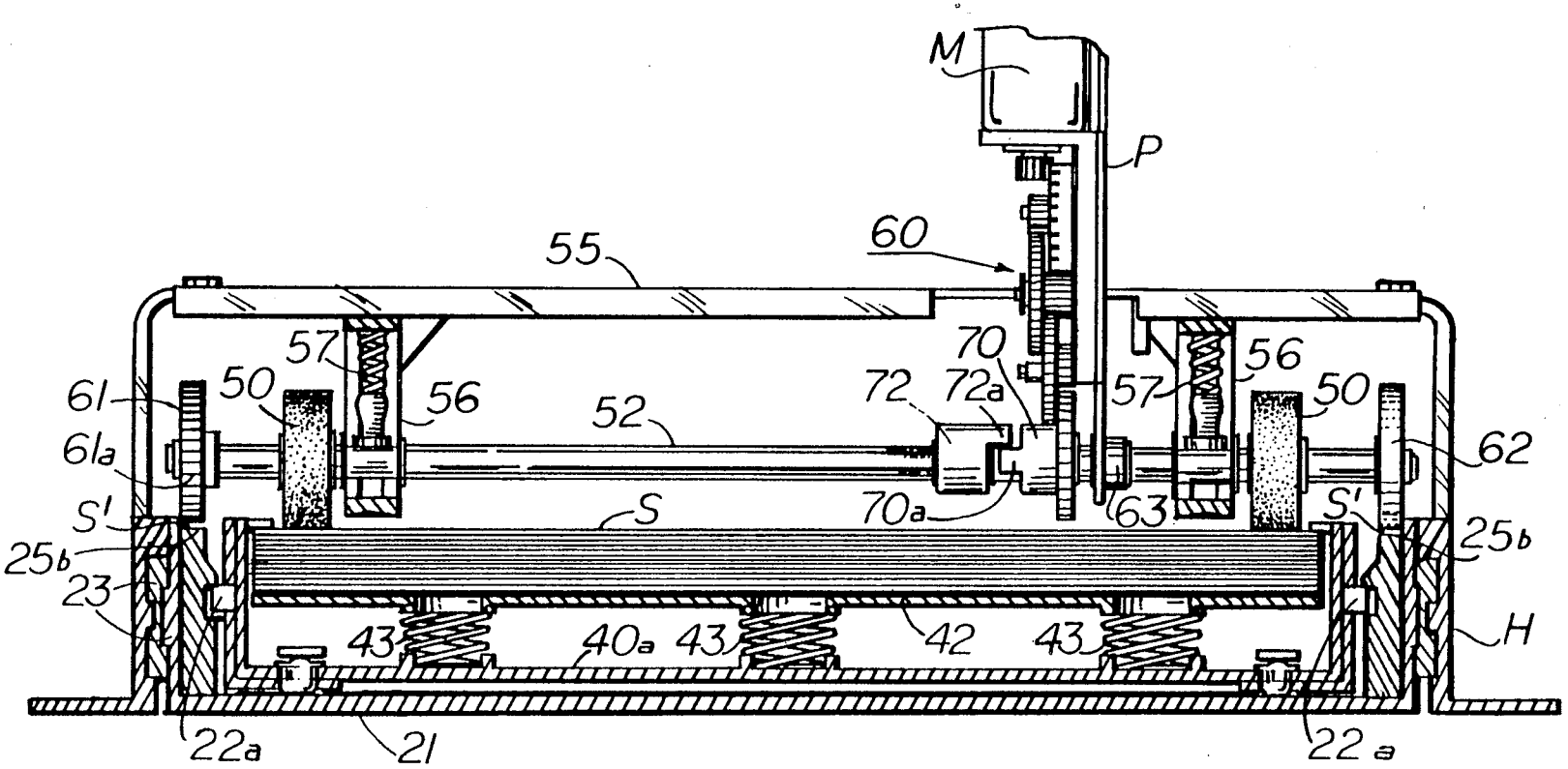
FIGS. 7 and 8 are cross sectional illustrations of the FIG. 2 apparatus.
Figure 8:
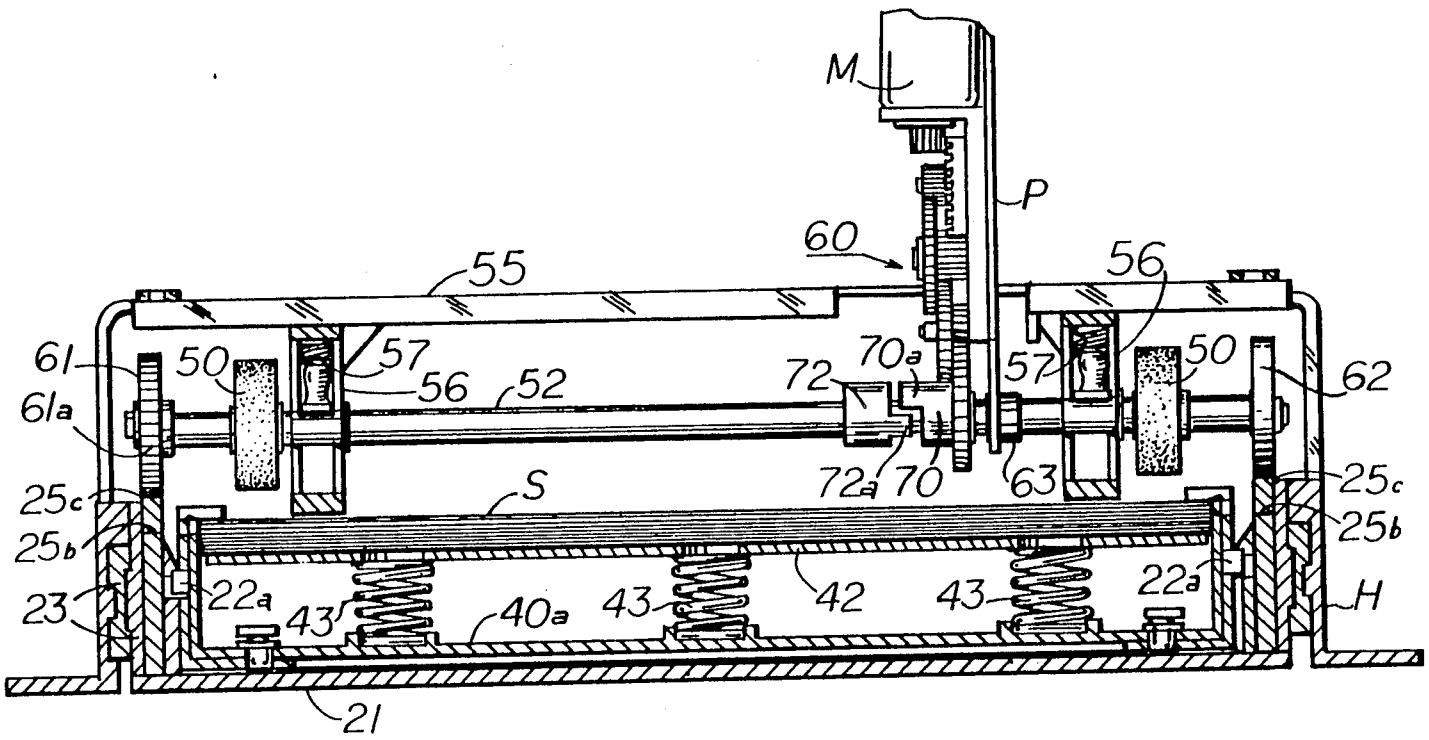

When sheet cassette 22 is loaded onto platform 21 and the latter is moved to its operative, sheet-feeding position, as shown in FIG. 3, rollers 61 and 62 are located on or, more preferably, slightly above the lower horizontal portion 25*b* of cam surface 25. In this position, shaft 52 is in its lowest position within slots 56*a*, and scuff rollers 25 drivingly engage the topmost in the cassette. Referring to FIG. 7, it will be seen that there is actually a small spacing S′ between trunion surface 25*b* and rollers 61 and 62 when shaft 52 is in its lowermost position.

This spacing assures that rollers 61 and 62 do not bottom-out before the scuff rollers reach the topmost sheet in the cassette as shaft 52 is lowered to its sheet-feeding position. When the motor M is energized, gear train 60 causes shaft 52 to rotate in the direction of arrow B, a direction in which the scuff rollers will feed sheets from the cassette. As noted above, such rotation of the drive shaft is effected by the engagement of drive gear 70 with driven member 72. When it is necessary or desirable to unload the sheet cassette from the printer, it is important to do so without having the sheet-feeding rollers disturb the alignment and registration of the sheets in the cassette. Also, in reloading the cassette into the printer, it is important that the sheet-feeding rollers be prevented from disturbing the sheet alignment or "pre-picking" the top sheet in the stack, i.e., causing it to buckle to the extent that the corners of the leading edge pop out of the corner snubbers 46. These potential problems are solved in the manner described below.

In removing the sheet cassette from the printer, platform 21 is slid outwardly from the printer housing on rails 23. In doing so, rollers 61 and 62 ride up the respective cam surfaces 25 of the trunion plates and thereby raise shaft 52 to a position in which rollers 50 no longer contact the sheet material. Further, sliding movement of platform 21 out of the printer causes the teeth on pinion roller 61 to engage rack 26 along the upper horizontal portion **25*c* of the cam surface 25. During this movement of platform 21 and the cam surfaces coupled thereto, the engagement between rollers 61 and 62 with the ramped and upper horizontal portions of the cam surface will cause shaft 52 to rotate in a direction causing the tang 72*a* on driven member 72 to move away from contact with tang 70*a* on drive gear 70. The one-way clutch incorporated in driven member 72 allows it to free wheel on shaft 52 to a position shown in FIG. 4 in which the opposite side (i.e. the non-driven side) of tang 72 engages the non-driving side of tang 70*a*. Without this one-way clutch feature, gear 70 and member 72 would lock up after approximately one revolution of shaft 52, thereby preventing further movement of pinion roll 61 on rack 26. Note, the rotation of member 72 provided by the rack and pinion drive to shaft 52 is many complete rotations, assuring the drive member 72 and drive gear 70 achieves the position shown in FIG. 4. Also, due to the one-way clutch mounting of pinion roller 61 on shaft 52, the pinion roller is actively coupled to the shaft while the pinion roller is rotating in a clockwise direction (as viewed in FIG. 2). During such movement, the positive engagement between teeth 61*a* and rack 26 will assure that tang 72*a* is reset to its furthermost position relative to tang 70*a***. This resetting feature is advantageous, as explained below.

Upon reloading a sheet cassette on platform 21 so that cassette pins **22*a* are located in notches 24*a* of trunion 24, platform 21 is slid into the printer apparatus, in the direction of arrow C in FIG. 2. During such movement, rollers 61 and 62 first ride along the upper horizontal portion 25*c* of cam surface 25, and then in a downward direction along ramp portion 25*a* until the scuff rollers engage the top sheet in the cassette. Note, due to the one-way clutch incorporated in toothed roller 61, the latter free-wheels on shaft 52 during this movement and, hence, has no effect on the relative positions of tangs 72*a* and 70*a*. Since roller 62 is free to rotate on shaft in either direction, its rotation never has any effect on the rotational position of shaft 52. When scuff rollers 50 initially engage the top sheet in the cassette, they are free to rotate on the sheet for nearly one full revolution, i.e., until tang 72*a* rotates back to a position in which it is engaged by tang 70*a*. In actuality, rollers 50 never need rotate this far, but it is important that they be given some freedom to roll after contact is made with the top sheet. If they could not rotate, as would be the case if there was no "slack" between tangs 72*a* and 70**, their initial engagement with the top sheet would cause a premature "pick" of the top sheet, as described above.

From the foregoing description, it will be appreciated that a relatively simple mechanical scheme is provided for lifting the feed rollers from the top sheet in the sheet supply whenever it is desirable to remove the sheet supply from the printer. Lifting of the feed rollers is accomplished without affecting the relative positions of the sheets in the stack. Moreover, during the process of returning the sheet stack to the printer, the feed rollers are brought into contact with the top sheet without any risk of a premature "pick," and the problems associated with it. Owing to the rack and pinion arrangement, and the one-way clutch mounting of driven member 72, the feed rollers are assured ample freedom to rotate after initially engaging the top sheet in the stack. Note, too, that the one-way clutch on pinion roller 61 always assures that the spacing between tangs **72*a* and 70*a* is reset to the maximum displacement whenever platform 21 is moved in an unloading direction (i.e., the direction of arrow A). Thus, there is no chance that, due to a repeated reciprocating movement of platform 21, the spacing between tangs 72*a* and 70*a*** will gradually become smaller and eventually disappear.

While the invention has been disclosed with particular reference to a preferred embodiment, various modifications will suggest themselves to those skilled in the art. For example, cam surface 25 could, if desired, be incorporated in the side walls **40*b* of the removable cassette 22, or be integral with the side walls of platform 21. Also, the sheet-feeding rollers 50** need not be of the "scuff" variety; rather, they could be conventional vacuum rollers which act, by vacuum, to separate the top sheet in the stack. Such variations are well within the scope of the invention, as defined by the appended claims.

We claim:

1. Sheet-feeding apparatus for use in a sheet-processing device for feeding sheet material along a predetermined path toward a sheet processing station, said apparatus comprising:

(a) a sheet supply station including means for supporting a stack of sheet material, said stack-supporting means being slidable along a rectilinear path between an operative, sheet-feeding position and an inoperative, sheet-loading position, said stack-supporting means having means defining a cam surface associated therewith which moves parallel to said rectilinear path during sliding movement of said stack-supporting means;

(b) sheet-feeding means located at a fixed location along said predetermined path for feeding sheet material, seriatim, from a stack of sheet material supported by said stack-supporting means when said stack-supporting means is located in its operative, sheet-feeding position, said sheet-feeding means comprising at least one sheet-feeding roller rigidly mounted on a rotatably-mounted drive shaft, said shaft being supported for movement perpendicular to said predetermined path between a first position in which said shaft locates said roller in a first position in which it engages the top-most sheet of a stack of sheet material supported by said stack-supporting means when positioned in said operative, sheet-feeding position, and a second position in which said shaft locates said roller in a position spaced from said topmost sheet, said sheet-feeding means further including means for biasing said shaft towards its first position; and (c) drive means for selectively rotating said drive shaft to cause said roller to feed the top-most sheet in the stack when said roller is positioned to engage such sheet; and (d) cam-follower means including a roller member rotatably mounted on said shaft and positioned to engage said cam surface during movement of said sheet-supporting means along said predetermined path, said cam surface being shaped to cause said drive shaft to move from said first position to said second position during movement of said sheet-supporting means between its operative and inoperative positions, respectively, said roller member being mounted on said shaft by means of a one-way clutch, whereby said roller member is rigidly coupled to said shaft during rotation of said roller member in a first direction, and decoupled from said shaft during rotation of said roller member in an opposite direction.

2. The apparatus as defined by claim 1 wherein said stack-supporting means comprises a sheet cassette for containing a stack of sheet material, and a slidably mounted platform for supporting said cassette, said platform having a pair of opposed side walls, said cam surface defining means being rigidly connected to at least one said side wall.

3. The apparatus as defined by claim 1 wherein a portion of said cam surface is provided with a rack of teeth, and wherein said circumference of said roller member defined a plurality of teeth adapted to cooperate with said rack of teeth to prevent slipping movement between said roller member and said cam surface.

4. The apparatus as defined by claim 1 wherein said drive means comprises a drive gear rotatably mounted on said shaft, a motor for selectively rotating said drive gear in a first direction, a driven member mounted on said shaft in a position to be engaged and rotatably driven by said drive gear in said first direction, and a one-way clutch for coupling said driven member to said shaft when said driven member is rotated in said first direction, and for decoupling said driven member from said shaft when said shaft is rotated in a direction opposite said first direction.

5. The apparatus as defined by claim 4 wherein said drive gear is provided with tang member extending substantially parallel to the axis of rotation of said drive gear, said tang member cooperating with a similar tang member on said driven member to cause said shaft to rotate as said drive gear is rotated by said motor.

6. The apparatus as defined by claim 5 wherein the tang member on said driven member becomes disengaged and separated by a predetermined minimum distance from the tang member or said drive gear every time said roller member rolls a predetermined distance along said cam surface.

* * * * *